US006581298B1

(12) United States Patent
Catallo

(10) Patent No.: US 6,581,298 B1
(45) Date of Patent: Jun. 24, 2003

(54) NOZZLE FOR FABRIC DRYER

(76) Inventor: Frank Catallo, 84 Wheatley Rd., Old Westbury, NY (US) 11568

( * ) Notice: Subject to any disclaimer, the term of this patent is extended or adjusted under 35 U.S.C. 154(b) by 0 days.

(21) Appl. No.: 10/052,658

(22) Filed: Jan. 23, 2002

(51) Int. Cl.[7] ..... F26B 19/00

(52) U.S. Cl. ..... 34/231; 34/633; 34/655; 34/487

(58) Field of Search ..... 34/231, 232, 629, 34/633, 638, 655, 459, 465, 487, 510; 26/18.5, 18.6

(56) References Cited

U.S. PATENT DOCUMENTS 3,739,491 A * 6/1973 Creapo et al. ..... 34/644
4,021,931 A * 5/1977 Russ et al. ..... 34/640
4,779,357 A * 10/1988 Troetscher ..... 34/638
5,105,562 A * 4/1992 Hella et al. ..... 34/643
6,018,886 A * 2/2000 Bell et al. ..... 34/380
6,173,507 B1 * 1/2001 Catallo ..... 34/397
6,289,607 B1 * 9/2001 Aaltonen et al. ..... 34/508

* cited by examiner

*Primary Examiner*—Ira S. Lazarus
*Assistant Examiner*—Kathryn S. O'Malley
(74) *Attorney, Agent, or Firm*—Charles E. Baxley

(57) ABSTRACT

A nozzle for a fabric dryer whose cross sectional area tapers from the proximal end thereof to the distal end thereof. The nozzle has a fabric side that is juxtaposed relative to the fabric. The fabric side of the nozzle is provided with a slot that extends therealong. The slot has flanges that penetrate away from the fabric side of the nozzle and open inwardly into the nozzle. A plurality of baffles are positioned between the flanges, along the slot. Each of the plurality of baffles is directed toward the fabric side of the nozzle and is inclined toward the proximal end of the nozzle to deflect hot air from the slot, so that the hot air projects normally onto the fabric so as to avoid moving the fabric off the fabric conveyor of the fabric dryer.

11 Claims, 4 Drawing Sheets

24
38
40
42
44
46
48
48'
50
52
54
9
14

NOZZLE FOR FABRIC DRYER

BACKGROUND OF THE INVENTION

1. Field of the Invention

The present invention relates to a fabric processing range. More particularly, the present invention relates to a fabric processing range which includes a dryer.

2. Description of the Prior Art

A fabric dryer comprises a housing and a hot air source. The hot air is projected against the fabric as the fabric travels on a conveyor along a longitudinal path through the dryer. Generally the hot air is delivered from the hot air source via one or more transversely disposed nozzles each having a proximal end in flow communication with the hot air source and a distal end remote therefrom across the fabric. A problem arises because the hot air being projected onto the fabric tends to move the fabric sidewise off the conveyor.

Thus, there exists a need for a nozzle for a fabric dryer that projects the hot air onto the fabric in such a manner so as not to move the fabric sidewise off the conveyor.

SUMMARY OF THE INVENTION

ACCORDINGLY, AN OBJECT of the present invention is to provide a nozzle for fabric dryer that avoids the disadvantages of the prior art.

ANOTHER OBJECT of the present invention is to provide a nozzle for fabric dryer that is organized to project hot air flow substantially at right angles onto the fabric so that lateral movement of the fabric is avoided. This object is achieved even though the hot air enters the nozzle from one side which otherwise would tend to shift the fabric sideways in the direction of the incoming hot air.

BRIEFLY STATED, STILL ANOTHER OBJECT of the present invention is to provide a nozzle for fabric dryer whose cross sectional area tapers from the proximal end to the distal end. The nozzle has a fabric side juxtaposed relative to the fabric. The fabric side is provided with a slot along the nozzle, the slot having flanges penetrating away from the fabric side and opening inwardly into the nozzle. A plurality of baffles are positioned between the flanges along the slot. Each of the baffles is directed toward the fabric side and inclined toward the proximal end to deflect the hot air from the slot so that it projects normally onto the fabric so as to avoid moving the fabric off the conveyor.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The invention will be understood more fully from the accompanying drawings which show a fabric dryer with the nozzle according to the present invention and wherein.

LIST OF REFERENCE NUMERALS UTILIZED IN THE DRAWING

Figure 1:
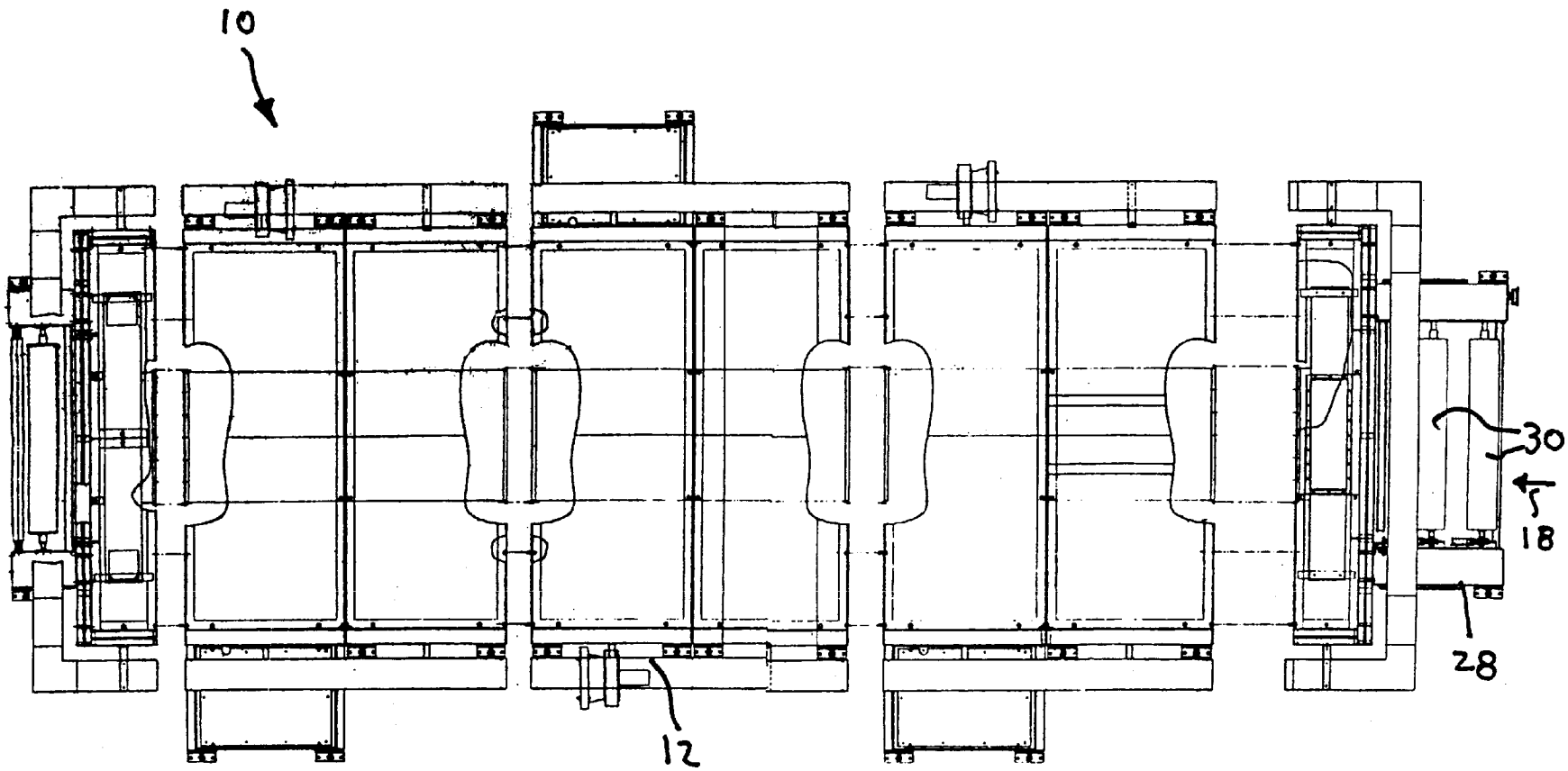
FIG. 1 is a top plan view of the fabric dryer.

10 fabric dryer
12 housing of fabric dryer 10
14 hot air source of fabric dryer 10
16 fabric conveyor of fabric dryer 10 for carrying fabric tube or web 18 without longitudinal tension along a longitudinal path through the housing 12
18 fabric
20 hot air blowers of fabric dryer 10
22 drives of hot air blowers 20 of fabric dryer 10
24 nozzles of fabric dryer 10
26 heaters of fabric dryer 10
28 control cabinet of fabric dryer 10
30 conveyor rolls of fabric dryer 10
32 exhaust duct of fabric dryer 10
34 exhaust stack of fabric dryer 10
36 exhaust blower of fabric dryer 10
38 proximal end of each nozzle of nozzles 24
40 distal end of each nozzle of nozzles 24
42 fabric side of each nozzle of nozzles 24
44 at least one slot in fabric side 42 of each nozzle of nozzles 24
46 pair of flanges of each slot of at least one slot 44 in fabric side 42 of each nozzle of nozzles 24
48 plurality of baffles of each nozzle of nozzles 24
50 inward end of each flange of pair of flanges 46 of each slot of at least one slot 44 in fabric side 42 of each nozzle of nozzles 24
52 plate of each nozzle of nozzles 24
54 pair of ears of plate 52 of each nozzle of nozzles 24

DETAILED DESCRIPTION OF THE PREFERRED EMBODIMENT

Figures 2, 3:
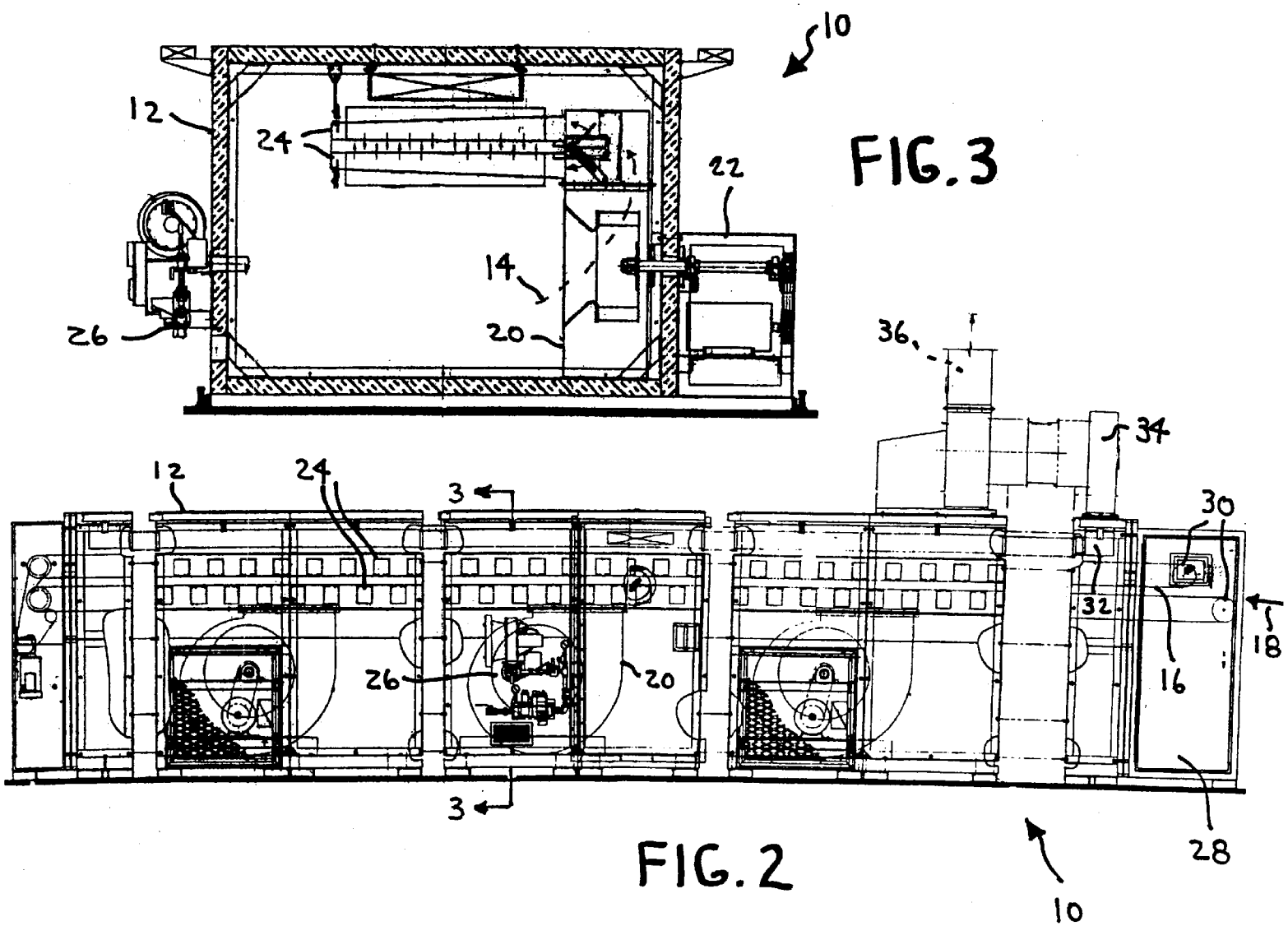
FIG. 2 is a side elevational view of the dryer.
FIG. 3 is a cross sectional view of the dryer taken along LINE 3—3 in FIG. 2.
Figure 4:
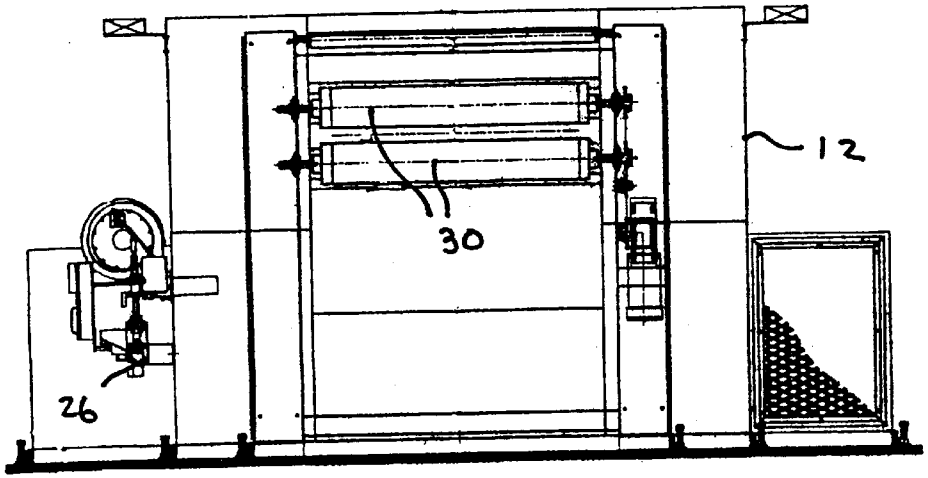
FIG. 4 is an elevational view of the left end of the dryer.
Figure 5:
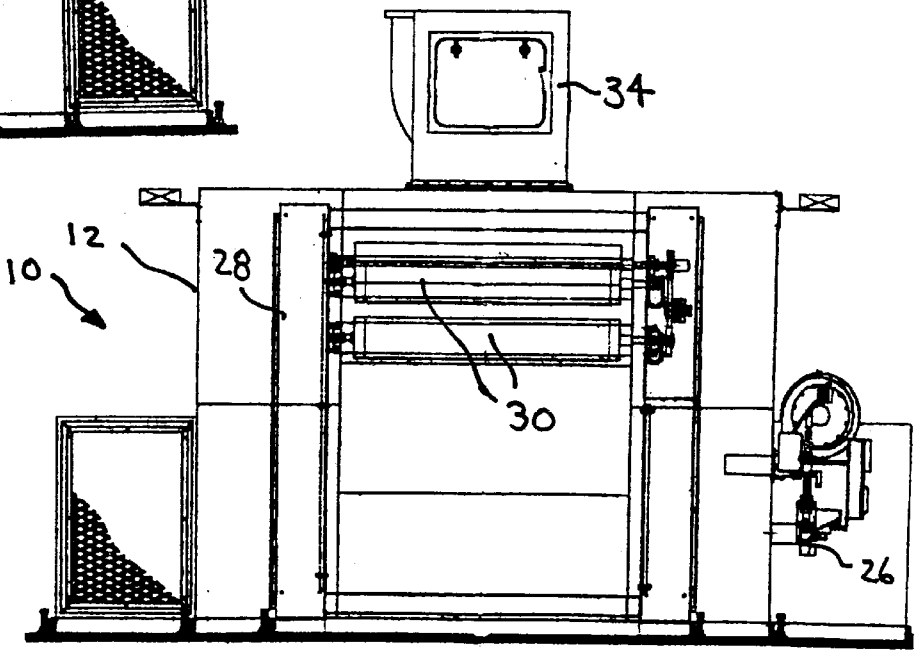
FIG. 5 is an elevational view of the right end of the dryer.

Referring now to the figures, in which like numerals indicate like parts, and particularly to FIGS. 1–5, which are, respectively, a top plan view of the fabric dryer, a side elevational view of the dryer, a cross sectional view of the dryer taken along LINE 3—3 in FIG. 2, an elevational view of the left end of the dryer, and an elevational view of the right end of the dryer, shown is a fabric dryer 10 having a housing 12, a hot air source 14 that may include heaters 26, a conveyor 16 for carrying a fabric tube or web 18, preferably without longitudinal tension along a longitudinal path through the housing 12, hot air blowers 20 with drives 22, nozzles generally designated 24 and disposed transversely relative to the conveyor 16 and extending across the fabric 18 from the hot air source 14, heaters 26, a control cabinet 28, conveyor rolls 30 moving the conveyor 16 past the nozzles 24, and an exhaust duct 32 connecting to an exhaust stack 34 equipped with an exhaust blower 36.

Providing moisture extracting apparatus close to the dryer 10 allows delivery of the fabric 18 from a wet condition substantially free of tension to the dryer 10 at moisture content sufficiently low to enable the dryer 10 to operate efficiently. For cotton fabrics 18 relatively small diameter (7") extractor rolls covered with hard 100 durometer rubber reduce the moisture content to less than 60%.

Figures 6, 7, 8, 9, 10:
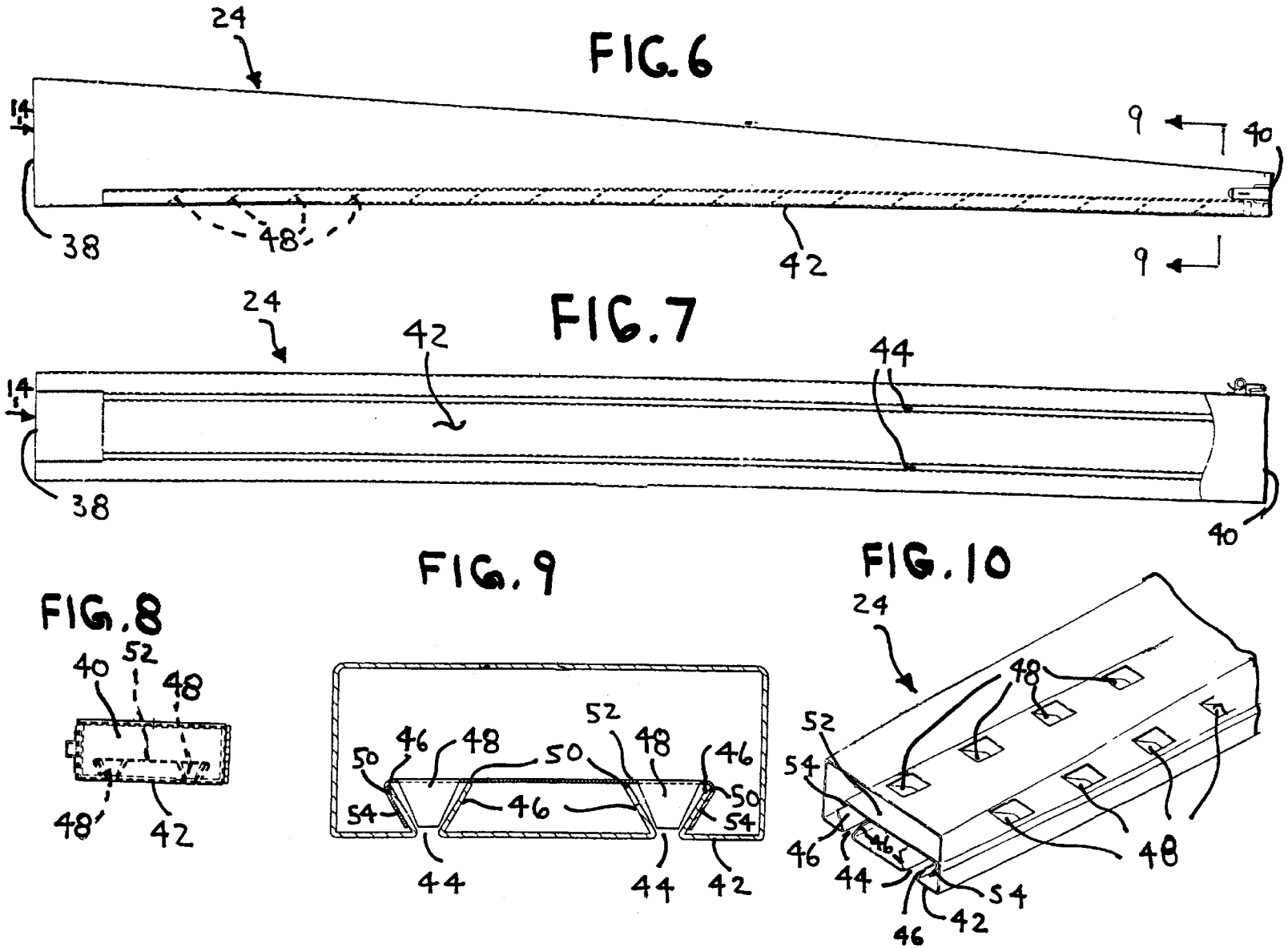
FIG. 6 is an enlarged side sectional view of the nozzle according to the present invention and depicting flow of hot air onto the fabric.
FIG. 7 is a fabric side view of the nozzle.
FIG. 8 is an end view of the nozzle.
FIG. 9 is a cross sectional view of the nozzle taken along LINE 9—9 in FIG. 6.
FIG. 10 is an enlarged broken perspective detailed view in section of the nozzle.

The configuration of each of the nozzles 24 can best be seen in FIGS. 6–10, which are, respectively, an enlarged side sectional view of the nozzle according to the present invention, a fabric side view of the nozzle, an end view of the nozzle, a cross sectional view of the nozzle taken along LINE 9—9 in FIG. 6, and an enlarged broken perspective detailed view in section of the nozzle, and as such, will be discussed with reference thereto.

Each of the nozzles 24 has a proximal end 38 that is in flow communication with the hot air source 14, a distal end 40 that is remote from the proximal end 38 thereof, a nozzle cross sectional area that tapers from the proximal end 38 thereof to the distal end 40 thereof, and a fabric side 42 that is horizontal and is disposed in the vicinity of the conveyor 16.

The fabric side 42 of the nozzle 24 is provided with at least one slot 44 therealong. Each slot 44 has a pair of flanges 46. Each of the pair of flanges 46 penetrates away from the fabric side 42 of the nozzle 24 and opens inwardly into the nozzle 24.

A plurality of baffles 48 are positioned between the pair of flanges 46, along the slot 44. Each of the plurality of baffles 48 is directed toward the fabric side 42 of the nozzle 24 and is inclined rearwardly toward the proximal end 38 of the nozzle 24 to deflect hot air in the slot 44 whereby the hot air projects substantially at a right angle onto the fabric 18 so as not to move the fabric 18 off the fabric conveyor 16.

Each of the pair of flanges 46 has an inward end 50 relative to the nozzle 24. A plate 52 is disposed horizontally, has the plurality of baffles 48 depending therefrom, sits on the pair of flanges 46, and has a pair of ears 54. Each of the ears 54 projects outwardly from the plate 52 and embraces respectively one of the outermost of the flanges 46.

The fabric side 42 of the nozzle 24 is provided with a plurality of the slots 44 therealong. Each of the plurality of the slots 44 has the pair of the flanges 46 and a plurality of the baffles 48 positioned between the pair of the flanges 46 along a relative slot 44.

It will be understood that each of the elements described above, or two or more together, may also find a useful application in other types of constructions differing from the types described above.

While the invention has been illustrated and described as embodied in a nozzle for fabric dryer, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. In a dryer having a housing and a hot air source, fabric conveyor means for carrying a fabric tube or web without longitudinal tension along a longitudinal path through the housing; a nozzle disposed transversely relative the conveyor means and having a proximal end in flow communication with the hot air source and a distal end remote therefrom and across the fabric from the hot air source, the nozzle having a nozzle cross sectional area that tapers from the proximal end to the distal end, the nozzle has a fabric side in the vicinity of the fabric conveyor means, the fabric side provided with a slot along the nozzle, the slot having a pair of flanges each penetrating away from the fabric side and opening inwardly into the nozzle, a plurality of baffles positioned between the flanges along the slot with each of the baffles directed toward the fabric side and inclined rearwardly toward the proximal end to deflect the hot air in the slot whereby it projects substantially at a right angle onto the fabric so as not to tend to move the fabric laterally off the conveyor means, each of the flanges has a plate with a pair of ears.

2. The nozzle as claimed in claim 1 with each of the flanges having an end inward relative to the nozzle, the plate seated on the ends, each of the pair of ears project from the plate outwardly relative to the nozzle to embrace respectively two of the flanges that are most remote from each other.

3. The nozzle as claimed in claim 2 with the fabric side provided with a plurality of the slots along the nozzle, each of the slots having a pair of the flanges, each of the slots having a plurality of the baffles positioned between an associated pair of the flanges along its relative slot.

4. The nozzle as claimed in claim 1 with the baffles depending from the plate.

5. The nozzle as claimed in claim 4 with the fabric side and the plate both horizontal.

6. The nozzle as claimed in claim 4 with the fabric side provided with a plurality of the slots along the nozzle, each of the slots having a pair of the flanges, each of the slots having a plurality of the baffles positioned between an associated pair of the flanges along its relative slot.

7. A method for drying a fabric tube or web utilizing a fabric dryer, wherein the fabric dryer has a housing, a hot air source for generating hot air, a conveyor for carrying the fabric tube or web without longitudinal tension along a longitudinal path through the housing, and at least one nozzle disposed transversely relative to the conveyor and extending across the fabric tube or web from the hot air source, wherein each of the at least one nozzle has a proximal end in flow communication with the hot air source, a distal end remote therefrom across the fabric tube or web from the hot air source, and a fabric side juxtaposed relative to the fabric tube or web; wherein the fabric side is provided with at least one slot therealong; wherein each slot has a pair of flanges penetrating away from the fabric side and opening inwardly into the nozzle; wherein each nozzle further has a plurality of baffles positioned between the pair of flanges, along the slot, and a plate with the plurality of baffles depending therefrom; wherein the plate is spaced from the pair of flanges and the plate has a pair of ears, said method comprises the steps of a) traveling the fabric tube or web on the conveyor without longitudinal tension along the longitudinal path through the housing;

b) delivering the hot air from the hot air source via the at least one nozzle; and c) projecting the hot air against the fabric tube or web without tending to move the fabric tube or web sidewise off the conveyor.

8. The method as defined in claim 7, wherein said step of projecting the hot air against the fabric tube or web without tending to move the fabric tube or web sidewise off the conveyor includes projecting the hot air substantially at right angles onto the fabric tube or web so as to avoid lateral movement of the fabric tube or web and the fabric tube or web does not tend to move sidewise off the conveyor even though the hot air enters the at least one nozzle from one side which otherwise would tend to shift the fabric tube or web sideways in a direction of incoming hot air.

9. The method as defined in claim 7, wherein each nozzle has a fabric side juxtaposed relative to the fabric tube or web;

wherein the fabric is provided with at least one slot therealong;

wherein each slot has a pair of flanges penetrating away from the fabric side and opening inwardly into the nozzle;

wherein each nozzle further has a plurality of baffles positioned between the pair of flanges, along the slot, and wherein said step of projecting the hot air against the fabric tube or web without tending to move the fabric tube or web sidewise off the conveyor includes deflecting the hot air from each slot by the plurality baffles so as to allow the hot air to project normally onto the fabric tube or web and avoid moving the fabric tube or web sidewise off the conveyor.

10. The method as defined in claim 9, wherein each nozzle has a plate with the plurality of baffles depending therefrom;

wherein the plate is spaced from the pair of flanges;

wherein the plate has a pair of ears;

wherein the pair of ears project outwardly from the plate and are parallel to and spaced from one of the pair of flanges and is further spaced from the fabric side of the nozzle; and wherein said step of projecting the hot air against the fabric tube or web without tending to move the fabric tube or web sidewise off the conveyor includes projecting the hot air to define an "S" shaped path from the nozzle around an ears, then between the ear and a flange, then between the flange and the plate to impinge laterally on a baffle to channel flow of the hot air from the baffle out the slot substantially at a right angle onto the fabric tube or web.

11. The method as defined in claim 7; further, comprising the step of providing moisture extracting apparatus close to the dryer so as to allow delivery of the fabric web or tube in a wet condition without tension to the dryer at a moisture content sufficiently low to enable the dryer to operate efficiently.

* * * * *